United States Patent [19]

Traster

[11] 4,342,990

[45] Aug. 3, 1982

[54] VIDEO DISPLAY TERMINAL HAVING IMPROVED CHARACTER SHIFTING CIRCUITRY

[75] Inventor: Elden D. Traster, Garland, Tex.

[73] Assignee: Harris Data Communications, Inc., Dallas, Tex.

[21] Appl. No.: 63,530

[22] Filed: Aug. 3, 1979

[51] Int. Cl.[3] ..... G09G 1/16

[52] U.S. Cl. ..... 340/724; 340/750; 340/799

[58] Field of Search ..... 340/723, 724, 731, 799, 340/703

[56] References Cited

U.S. PATENT DOCUMENTS

| | | | |
|---|---|---|---|
| 3,659,283 | 4/1972 | Ophir | 340/731 |
| 3,918,040 | 11/1975 | Beuter et al. | 340/724 |
| 3,976,990 | 8/1976 | Haak | 340/724 |
| 3,988,728 | 10/1976 | Inoue et al. | 340/724 X |
| 4,141,003 | 2/1979 | Felsenstein | 340/799 |
| 4,246,578 | 1/1981 | Kawasaki et al. | 340/724 X |

*Primary Examiner*—David L. Trafton
*Attorney, Agent, or Firm*—Yount & Tarolli

[57] ABSTRACT

A video display terminal is disclosed for use in displaying images of data characters on a display screen. Multibit coded data words are supplied by a data source, such as a memory, to a character generator circuit which controls the display of data characters on the face of a video display screen. Character codes are used to address a dot pattern memory which stores dot patterns to provide an image of the required data character to be displayed. The dot patterns may be stored on one size matrix in the dot pattern memory, such as in a 9×9 cell, and displayed on a larger dot matrix, such as 9×16, on the display screen. Subscripts or descending characters may be stored in the dot pattern memory and vertically repositioned when displayed on the screen. Means are also provided for adjusting the vertical positioning of a line of characters.

12 Claims, 5 Drawing Figures

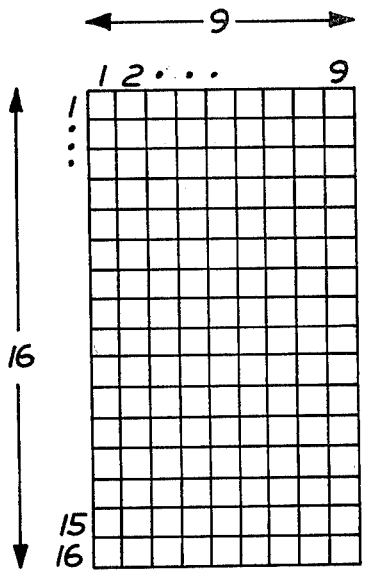
FIG.3
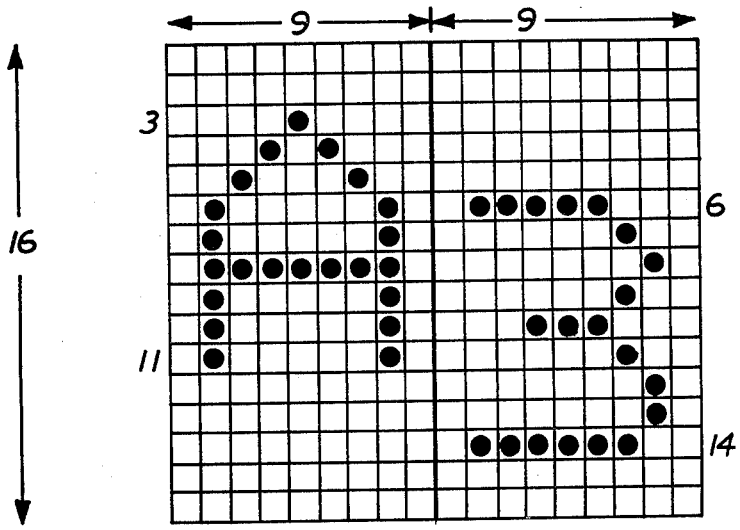
FIG.4
FIG.5
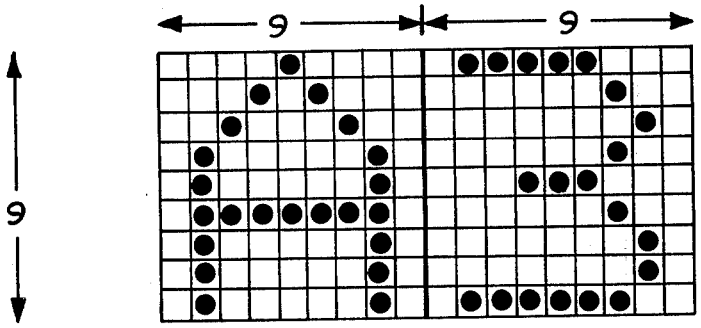

VIDEO DISPLAY TERMINAL HAVING IMPROVED CHARACTER SHIFTING CIRCUITRY

BACKGROUND AND FIELD OF THE INVENTION

This invention relates to video display of images and, more particularly, to improvements in displaying and shifting dot pattern images of characters so as to permit greater display screen bandwidth and to increase dot storage efficiency.

Whereas the invention is described herein in conjunction with a video display system incorporating a host computer and individual terminals, it is to be appreciated that the invention is not limited thereto, but may also be employed in a stand alone video display terminal or other apparatus where it is desirable to vary the positioning of dot patterns forming a character image and for minimizing the amount of storage required to provide dot patterns.

A typical video display terminal employes a TV type raster scan generator for presenting images of characters as a series of dots. Each character, may be formed within a dot matrix, such as a 7×9 matrix, within a somewhat larger character field matrix, such as 9×16. Because of subscripts or descending characters, some of the characters are positioned vertically different than others and, hence, a line of characters displayed on a screen may require much of the 9×16 dot matrix. Consequently, a stroke memory, typically implemented in the form of a read only memory (ROM), will require for each character upwards of 16 dot pattern strokes, even though the characters themselves may fall within a 7×9 dot matrix. But for such descending characters and subscripts, each character might fall within a 7×9 matrix and the read only memory would only need to store 9 stroke patterns for each character. Because of the necessity to provide for descending characters and subscripts, the storage requirements, then, of such a stroke generator memory is increased.

SUMMARY OF THE INVENTION

It is an object of the present invention to provide increased bandwidth for a display screen in a video display terminal wherein a pattern storage memory may store dot patterns in a compressed form describing a dot matrix substantially smaller than the dot matrix on the display screen.

It is a still further object of the present invention to provide means for shifting a dot pattern in a direction transverse to the raster scan pattern by a selected amount.

In accordance with one aspect of the present invention apparatus is provided for use in a TV raster scanning character display system wherein stroke patterns for forming the characters to be displayed are stored in a font memory and are retrieved therefrom by addressing the font memory with character codes and line counts. The character codes identify the character to be displayed and the line counts indicate which stroke of the character is to be displayed, the line count normally remains unchanged during the scanning of each line of the raster. The apparatus comprises means for designating those characters which are to be displaced from their normal display location and means for changing the line count from its normal value to a different value when the character codes for the designated characters are presented to the font memory. Because of this, different strokes are retrieved from the font memory for the designated characters than for the nondesignated characters, resulting in the display of the designated characters at a displaced location relative to the nondesignated characters.

BRIEF DESCRIPTION OF THE DRAWINGS

The foregoing and other objects and advantages of the invention will become more readily apparent from the following description of the preferred embodiment of the invention as taken in conjunction with the appended drawings wherein:

FIG. 3 is a schematic illustration of a character field display matrix on a CRT screen;

FIG. 4 is a schematic illustration of two characters displayed on a screen; and FIG. 5 is a schematic illustration of two characters displayed on a screen in a compressed format.

DETAILED DESCRIPTION

GENERAL DESCRIPTION

Reference is now made to the drawings wherein the showings are for purposes of illustrating a preferred embodiment of the invention only and not for purposes of limiting the same.

Figure 1:
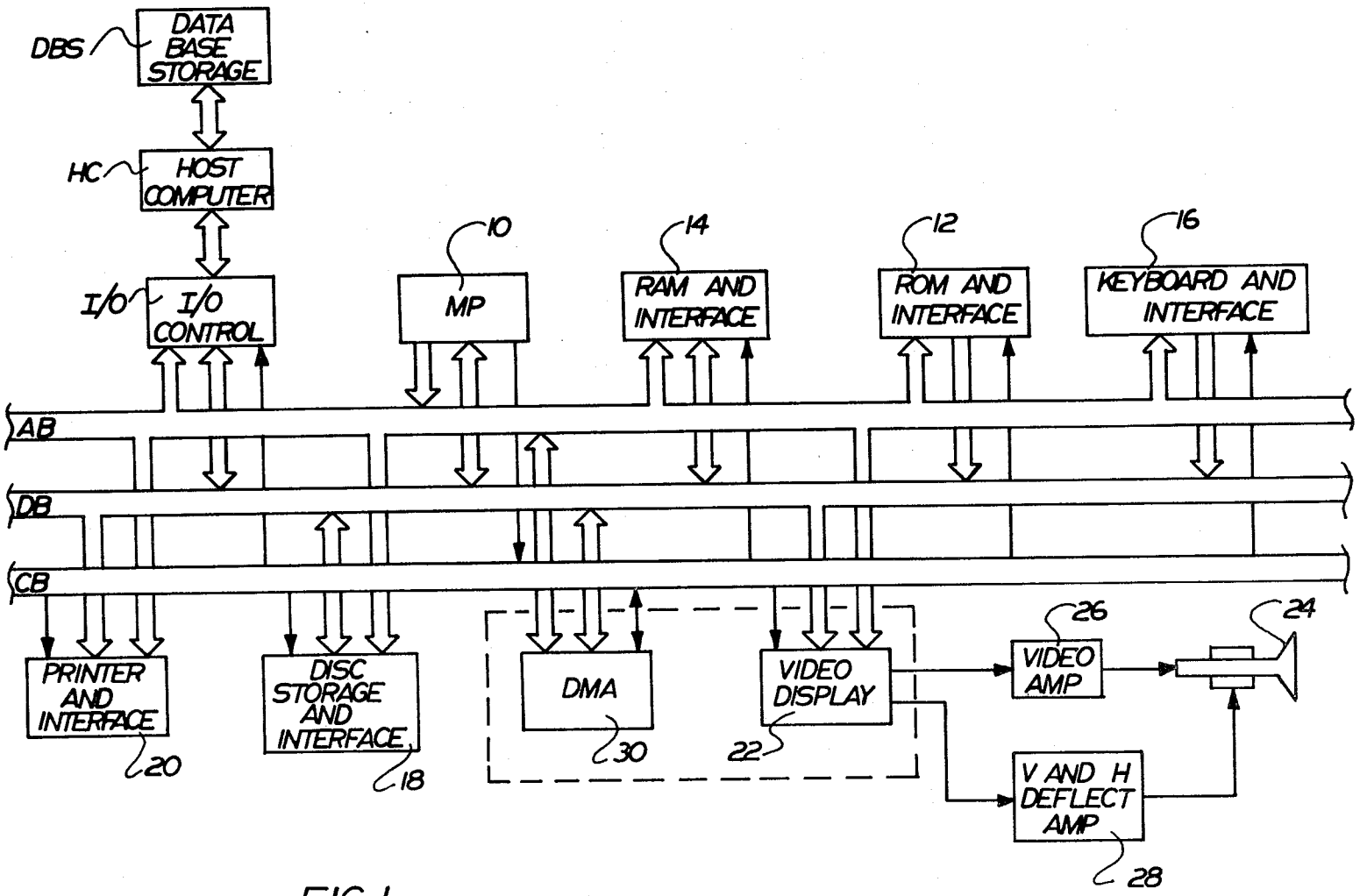
FIG. 1 is a schematic-block diagram illustration of one application of the present invention.

FIG. 1 is a schematic-block diagram illustration of a video display terminal which may interact with a host computer. The terminal is a processor driven terminal employing a common bus structure including an address bus AB, a data bus DB, and a control bus CB. The address bus AB may, for example, be a sixteen bit bus, whereas the data bus may be an eight bit bus. An interface to the host computer HC may be had by way of a suitable input/output control IO. This conventionally includes a universal synchronous, asynchronous receiver transmitter (USART). The input/output control IO communicates in a conventional manner with the address bus, the data bus and the control bus. Also connected to the common bus is a microprocessor 10 and external memories 12 and 14. Memory 12 may store the instruction sets for the processor and may take the form of a read only memory (ROM). Instruction sets are obtained from memory 12 in response to a program counter in the processor placing an address on the address bus AB. Memory 12 then responds by outputting data in the form of an instruction set to the data bus DB in a conventional fashion.

Data to be displayed or otherwise manipulated by the processor is stored in memory 14 and takes the form of a read/write random access memory (RAM). The data stored in memory 14 may be obtained from an input peripheral such as a keyboard 16, the host computer HC, a tape reader or the like, or perhaps a local disc storage such as storage 18. Under program control, data may be outputted to such output peripherals as a conventional printer 20 or by way of the input/output control IO to the host computer HC for storage at the data base storage DBS. Additionally, data to be displayed may be outputted to a video display circuit 22 for subsequent display on the face of a cathode ray tube 24. Suitable amplifying circuits including a video amplifier 26 and a vertical and horizontal deflection amplifier 28 are employed and used in a conventional manner. Data to be fetched from RAM 14 for subsequent display on the cathode ray tube may be accessed by means of a direct memory access circuit 30 of conventional design, such as that known as model AMD9517. Such a memory access circuit serves in response to control signals, as from a character generator within the video display 22, to fetch data from memory 14 by way of the data bus DB. This data is then supplied to the video display control circuit where it may be buffered to provide video patterns representative of the data characters for display on the cathode ray tube.

Figure 2:
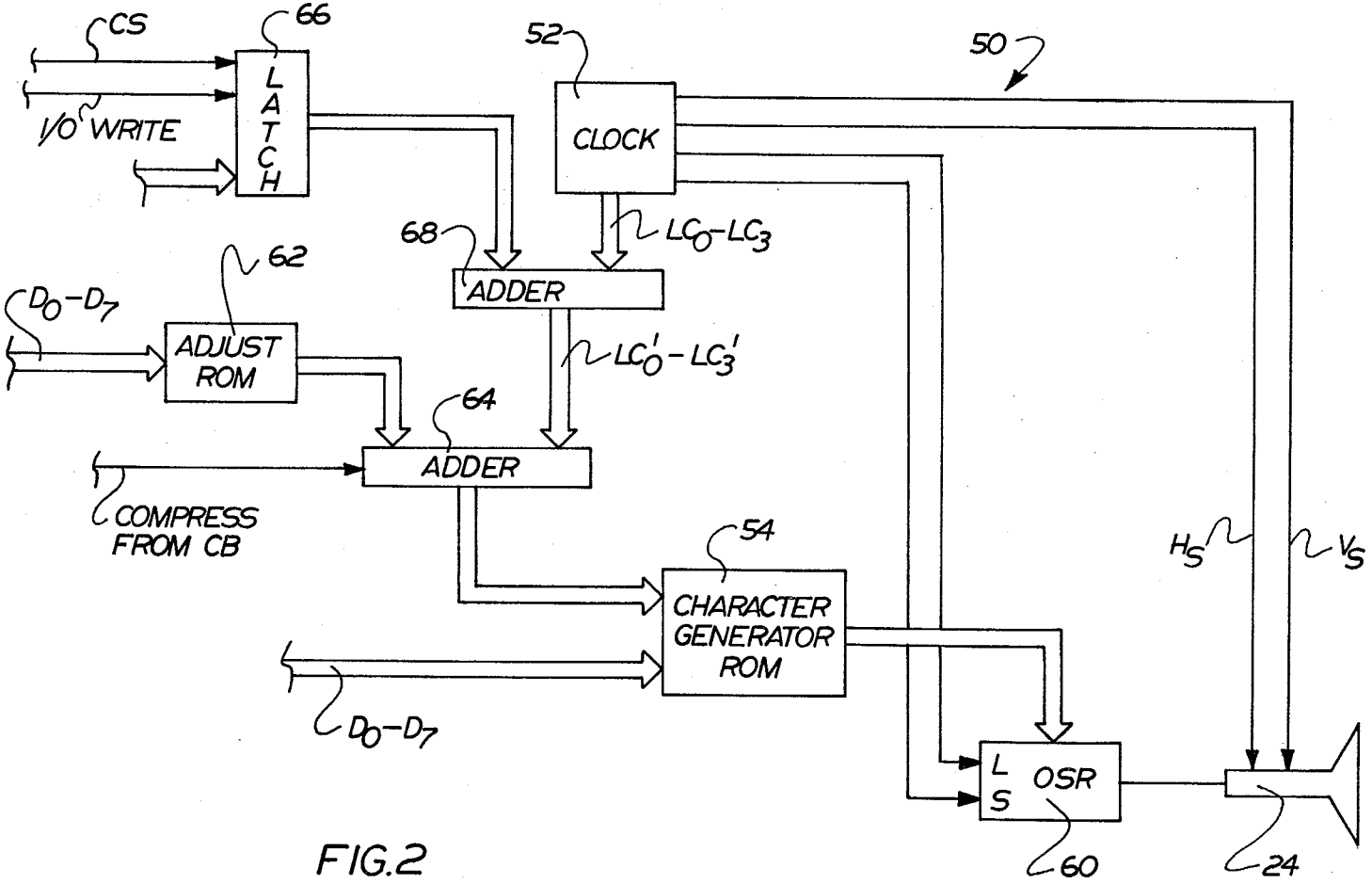
FIG. 2 is a schematic-block diagram illustration showing in greater detail the video display circuitry employed in conjunction with the present invention.

Reference is now made to FIG. 2 which illustrates the video display circuit in greater detail. This circuit employs a character generator 50 which utilizes a TV type raster scan, the scanning of which is controlled by horizontal and vertical synchronizing signals $H_s$ and $V_s$ provided by a suitable timing and control circuit, sometimes referred to hereinafter as clock circuit 52. In this type of display, each horizontal scan line generates a linear segment or "stroke" of each of the characters being displayed at that vertical position on the screen. Character generator 50 serves to control the generation of alphanumeric characters for display on the face of the cathode ray tube 24. In a conventional fashion, a read only memory 54 stores a font of dot patterns for the various characters and symbols to be displayed by the cathode ray tube 24. Each character is displayable within a 9×16 dot matrix pattern. The address for addressing a dot pattern stored in memory 54 is obtained from the coded characters supplied to the data bus DB by memory 14. These coded characters may be first buffered, as with a line buffer, so that a line of coded characters corresponding with a line of characters to be displayed are stored. These data characters may also be supplied directly to the character generator ROM 54.

Memory 54 stores a font of dot patterns of the various characters and symbols to be displayed by the cathode ray tube 24. Each dot character or symbol is displayable within a character field, such as a 9×16 dot matrix. The dot character itself may take up only a 7×9 dot matrix pattern, however, the additional dots are required for intercharacter and interline spaces and descending characters. The address for addressing a dot pattern stored in memory 54 is obtained from the data bus coded word $D_0$–$D_7$ and from a four line coded line count $LC_0$–$LC_3$ obtained from the video control and timing circuit 52. During the generation of a line of characters with a TV raster scan, each scan lays down one slice or dot pattern segment (also known as a stroke) for each of the characters on a line. Succeeding scans provide the remaining slices or dot segments. Consequently, then, for a 9×16 dot character field, sixteen scan lines may be required. This means that for each character generated, the memory 54 must be addressed at least sixteen times for the potential sixteen dot segments and this line of data characters in the line buffer will be recirculated at least sixteen times and the count provided by the line count data will be incremented with each circulation. The address, then, for each dot pattern is a combination of the line count together with the character code obtained from the data bus.

Each time a line segment dot pattern is outputted from memory 54, it appears as a bit pattern which is loaded in parallel into an output shift register 60 when that register receives a load signal from clock 52. The dot pattern is shifted in bit serial fashion out of the output shift register in synchronism with shift or clock pulses supplied to the shift input of the register 60 from clock 52. As is conventional, the dot pattern segments control the blanking-unblanking operation of the cathode ray tube. As the beam is being scanned horizontally across the screen, a dot pattern is displayed with each line segment being in accordance with the associated bit pattern outputted from register 60. At the end of a scan line there will be an interval which may be considered as the horizontal blanking interval and it is during this interval that a horizontal synchronization signal $H_s$ is provided by the timing control circuit 52. This, in a conventional fashion, causes the beam to flyback or retrace to its original location where the beam is automatically incremented downwardly by one scan line in a position to commence tracing of a second scan line across the face of the cathode ray tube. The scans will continue through a character line, which, in the embodiment being described, will require sixteen scan lines. The number of visible character lines in a vertical direction will be determined in large measure by the size of the cathode ray tube. In the example being given, that may be on the order of sixteen character lines, each requiring sixteen scan lines. A vertical blanking interval will occur at the bottom of the screen for approximately 30 scan lines and it is during this interval that a vertical synchronization signal $V_s$ is generated by the control and timing circuit 52. This causes the beam to flyback to its home position, normally located in the upper left-hand corner of the cathode ray tube.

Reference is now made to FIG. 3 which illustrates a 9×16 dot matrix character field. It is within this field that a dot pattern within a 7×9 matrix is formed so as to provide an image of a particular character on the face of the cathode ray tube 24. As is known, some characters are descender characters such as a small g and in other cases there are ascender characters such as a prime, i.e., A'. Additionally, such characters are associated with a subscript such as $A_3$. Because of these ascender characters, descender characters, and subscripts, the dot pattern generator storage means, in this case the memory 54, would conventionally store the 7×9 stroke patterns within a 9×16 cell in the memory. Consequently, then, much of the memory storage capacity is wasted on blank lines. For example, in FIG. 4 there is shown a character A together with the subscript 3 forming $A_3$. The uppermost dot pattern of the character may commence with scan line 3 on the face of a cathode ray tube, whereas the lowermost portion of the character corresponds with scan line 11. This constitutes a total of nine scan lines. Those above scan line 3 and those below scan line 11 represented wasted storage area within the memory 54. This blank space is necessary, however, to accommodate such things as descenders and subscripts, i.e., subscript 3 shown in FIG. 4. These descenders and subscripts may also be represented within a 7×9 dot matrix having its uppermost line corresponding with scan line 6 and its lowermost line corresponding with scan line 14. Both of these types of characters may be requested for display on the cathode ray tube, however, hence it is common to store, in the dot pattern memory, several blank lines above and below such characters.

In accordance with the present invention, the dot pattern storage requirements are minimized by compressing the dot patterns as stored in memory so as to correspond essentially with that as illustrated in FIG. 5. Here, the subscript 3 is stored so that its upper dot pattern segment corresponds in location with the upper dot pattern of character A and similarly, the lowermost dot pattern of this subscript corresponds in location with the lowermost dot pattern segment of the character A. This permits all characters to be stored within a 9×9 cell within memory 54. Since these are displayed within 7×9 dot matrix patterns, the additional two spaces in a horizontal direction are used as intercharacter space. This permits, then, a choice when displaying such a 7×9 character on a 9×16 character field (FIG. 3) to display the characters either as is indicated in FIG. 4 or as is indicated in FIG. 5 (compressed format). If characters are displayed in a compressed format (FIG. 5) then this will save substantial screen bandwidth since a 16-dot high matrix which is used for 25 character lines on a screen will, when converted to such a 9-dot high matrix provide 48 character lines on a screen.

Attention is now directed back to FIG. 2 and the following description dealing with the manner in which the video circuitry is implemented so as to provide a video display in either in a compressed or noncompressed format. The dot patterns stored in memory 54 may now be stored in 9×9 cells instead of 9×16 cells and, hence, substantial space is saved. However, since the characters in a noncompressed form are to be displayed in a 9×16 character field (FIG. 3) 16 scan lines will be required for each character. An adjustment memory 62, in the form of a read only memory (ROM) serves to store locations on the screen to determine where the 9×9 matrix stored in memory 54 is to be displayed on the 9×16 display matrix. This is done on a character by character basis. Memory 62 need only be a small memory since only scan line modifications are being stored and, for example, may take the form of a 4 bit by 256 word memory. In operation, as a data character is being supplied on the data bus, it provides an address to the character generator memory 54 in order to obtain the stroke patterns therefrom. This same address is supplied to the adjustment memory 62 which will then provide for that character the location within the 9×16 display matrix that the character is to be displayed. This, for example, may take the form of an address for the uppermost stroke to be displayed.

The characters may be displayed in a compressed mode in that the characters are displayed on a 9×9 matrix (FIG. 5) similar to the storage cell for the stroke patterns. This, then, would increase the number of display lines on the screen of the cathode ray tube. In this compressed mode, adder 64 serves no function and the line count is supplied to the character generator memory 54 so that on scan lines 1–9 different dot patterns for a particular character are obtained from memory 54 with the character selected being that in accordance with the address obtained from the data bus ($D_0$–$D_7$). But, in the noncompressed mode of display (FIG. 4) the adder 64 serves to add to the line count $LC_0$–$LC_3$ the address of the uppermost line on the screen that the character is to be displayed.

Thus, for example with respect to FIG. 4 the character A is to be displayed within a 7×9 dot matrix within a 9×16 character field. Since the uppermost dot pattern corresponds with line 3 within the 9×16 matrix, then on scan line 1, a number corresponding with −2 is added to the adder from memory 62 so that first dot segment from memory 54 (stored as is shown in FIG. 5) will not be outputted to the output shift register 60 until the line counter has obtained a count of 3. This will continue for the character A. However, for a descending character, such as numeral 3 (FIG. 4), the uppermost line segment commences at line 6 on the display field (FIG. 3). Consequently, whenever this character is being called for, ROM 62 outputs the number corresponding with −5 so that the first line of dot segments for this character will not occur until a line count of six has taken place. A similar analysis is made with respect to other subscripts or descenders or ascenders. This noncompressed mode of operation will take place so long as adder 64 is enabled (it is disabled for compressed operations by the raising the compress output from control bus CB).

An entire line of characters may be raised or lowered within the character field (FIG. 3) as displayed on the screen by modifying the line count $LC_0$–$LC_3$ with an adder 68 so that the outputted line count to adder 64 may be considered as line count $LC_0'$–$LC_3'$. The input to the adder 68 is obtained from a latch register 66 which will be loaded from the data bus with a line count modification number whenever the register is addressed, as from a chip select signal CS and data is written on an I/O write command. Since the line count serves as part of the address for addressing a character stroke pattern stored in memory 54, a change in the line count status will either lower or raise the positioning of the character within the character field. Thus, for example, if the character A in FIG. 4 is normally displayed within a 9×16 character field so that its top stoke pattern corresponds with the third line within the character field, the addition of the count of 2 to the line count would cause the character to be raised by two lines within the character field. In this case, the data supplied to the latch register would provide an additional factor of two line counts. The opposite would be achieved by entering a negative count of 2. This feature on a character line basis may be used and superimposed on top of the operation discussed above and it may be particularly useful in conjunction with the noncompressed mode of display.

In summation, it is seen that bandwidth may be added to the screen display of a cathode ray tube if, for example, characters normally displayable within a 7×9 dot matrix inside a 9×16 character field be stored within 9×9 dot cells in a stroke pattern memory such as memory 54. The characters may then be displayed for a quick review thereof, in a compressed format, as illustrated in FIG. 5. In doing this, however, circuitry such as that illustrated in FIG. 2 is required in order to display the characters in a noncompressed format, such as is illustrated by FIG. 4. This is done by storing on a character by character basis the effective address for the uppermost stroke pattern to be displayed on the screen.

Although the invention has been described in conjunction with the preferred embodiment, it is to be appreciated that various modifications may be made within the spirit and scope of the invention as defined by the appended claims.

What is claimed is:

1. Apparatus for use in a line by line raster scanning character display system wherein stroke patterns for forming the characters to be displayed are stored in a font memory and are retrieved therefrom by addressing said font memory with character codes identifying the character to be displayed and line counts indicating which stroke of the character is to be displayed, where the line count normally remains unchanged during the scanning of each line of the raster, comprising:

means responsive to said character codes for designating those characters which are to be displaced from their normal display location, and means for changing the line count from its normal value to one of a plurality of values in dependence upon said character codes when the character codes for the designated characters are presented to the font memory, whereby different strokes are retrieved from the font memory for the designated characters than for nondesignated characters at a displaced location relative to said nondesignated characters.

2. Apparatus as set forth in claim 1, wherein said designating means comprises memory means addressable by said character codes substantially concurrently with the addressing of said font memory by said character codes.

3. Apparatus as set forth in claim 1, wherein said designating means comprises memory means for storing adjustment values for at least some of the characters to be displayed, said memory means being addressable by said character codes to retrieve said adjustment values, and wherein said line count changing means comprises means for adjusting said line counts in accordance with said adjustment values retrieved from said memory means.

4. Apparatus as set forth in claim 3, wherein said adjusting means comprises means for subtracting said adjustment value from said line count to thereby derive said changed line count.

5. Apparatus as set forth in claim 3, and further comprising second line count adjustment means for further adjusting said line count for any selected character or group of characters in accordance with a controllable adjustment value, whereby said any one or group of characters may be controllably shifted to occupy positions within said character field which are different than those which they would otherwise occupy.

6. Apparatus as set forth in claim 1, and further comprising means for disabling said line count changing means whereby said characters are all displayed at nondisplaced positions, thereby compressing the area required to display said characters.

7. Apparatus for use in a system employing TV raster scanning for displaying characters within uniformly sized character fields on a display screen, each of said characters being representable within a smaller field, also uniformly sized and embedded within said character field but where the location of said smaller field within said character field varies from character to character in a direction transverse to the line scans of said TV raster scanning, said apparatus comprising:

font memory means for storing stroke patterns for forming said characters, said memory means storing only those stroke patterns extending across said smaller character field, where said stroke patterns are retrieved from said memory means by addressing said memory means with character codes identifying the character to be displayed and line counts identifying the one of said smaller field stroke patterns to be displayed, means for providing line counts identifying which stroke pattern of said character field is to be displayed, and means responsive to said character codes for adjusting said character field line count by an adjustable amount and direction in dependence upon each said character code as required for each character code to derive the corresponding said smaller field line count, and for applying said smaller field line count to said font memory means, whereby each character stroke of each character is retrieved from said font memory at the appropriate point in the display of said character field.

8. Apparatus as set forth in claim 7, wherein said line count adjusting means comprises means for subtracting an adjustment count from said character field line count to derive said smaller field line count, and means responsive to said character codes for providing said adjustment counts in accordance therewith.

9. Apparatus as set forth in claim 8, wherein said means for providing said adjustment counts comprises memory means for storing adjustment counts for at least some of said characters and addressable by said character codes for retrieving said adjustment counts.

10. Apparatus as set forth in claim 7 wherein said adjusting means may be disabled so that the adjustment to the character field line count provided thereby does not vary from character to character, whereby all said characters are displayed within an area having a compressed dimension transverse to said line scans of said TV raster scanning.

11. An apparatus as set forth in claim 7, and further comprising second line count adjustment means for adjusting one of said character field or smaller field line counts in accordance with a line displacement count, and means for controllably providing a line displacement count for any one or group of characters to be displayed, whereby said any one or group of characters may be controllably shifted to occupy positions within said character field which are shifted from the positions which they would otherwise occupy.

12. Apparatus for use in a system for displaying characters in character fields on a display surface being scanned in a conventional TV raster scanning pattern, said system including means for providing a stream of character codes in synchronization with said scanning of said character fields by said energy beam, each of said character code representing the character to be displayed in the character field then being scanned, means for providing line counts in synchronization with said raster scanning, said line count identifying the location of the line presently being scanned relative to the boundaries of the character fields being scanned, character font memory means addressed by said character codes of said stream of characters and by said line counts for providing dot pattern line segments in accordance therewith, said line segments representing the video intensity pattern to be formed during the scan of that line of that character field, and video display means for forming said video intensity patterns on said display surface during said raster scanning, said apparatus comprising:

means responsive to said character codes for providing indications having values dependent upon said character codes as to whether the character displayed in the character field then being scanned should have a displaced location relative to its normal location in the character field and wherein said indications include the direction and amount of the displacement; and means interposed between said line count providing means and said font memory means and responsive to said indications for adjusting said line count to provide an adjusted line count for addressing said font memory means when said displayed character is to be displaced, whereby said characters are displayed in displaced locations in their character fields.

* * * * *